US005816620A

United States Patent [19]

Buell

[11] Patent Number: 5,816,620

[45] Date of Patent: Oct. 6, 1998

[54] KEY LOCATOR

[76] Inventor: Robert Buell, 10730 E. Artesia Blvd., Cerritos, Calif. 90703

[21] Appl. No.: 782,916

[22] Filed: Jan. 13, 1997

[51] Int. Cl.[6] ..... B42D 15/00

[52] U.S. Cl. ..... 283/74; 283/75; 283/76

[58] Field of Search ..... 283/74, 75, 76

[56] References Cited

U.S. PATENT DOCUMENTS

| | | | |
|---|---|---|---|
| 3,640,009 | 2/1972 | Komiyama | 283/75 |
| 4,271,352 | 6/1981 | Thomas | 283/75 |
| 4,450,024 | 5/1984 | Haghiri-Tehrani et al. | 283/75 |
| 4,523,088 | 6/1985 | Utsch | 235/487 |
| 4,763,930 | 8/1988 | Matney | 283/81 |
| 4,911,478 | 3/1990 | Oshikoshi et al. | 283/74 |
| 5,238,272 | 8/1993 | Taylor | 285/79 |
| 5,290,066 | 3/1994 | Mody | 281/15.1 |
| 5,380,046 | 1/1995 | Stephens | 283/75 |
| 5,419,591 | 5/1995 | Lambert et al. | 283/79 |
| 5,570,081 | 10/1996 | Holstrom | 283/74 |

FOREIGN PATENT DOCUMENTS

| | | | |
|---|---|---|---|
| 3330261 | 3/1985 | Germany | 283/74 |
| 5-16577 | 1/1993 | Japan | 283/74 |
| 2223714 | 4/1990 | United Kingdom | 283/76 |
| 2272667 | 5/1994 | United Kingdom | 283/74 |

*Primary Examiner*—Daniel W. Howell
*Assistant Examiner*—Adesh Bhargava

[57] ABSTRACT

The present invention relates to a key locator (10) having a tag (12). A key attachment means (14) is securely attached to the tag (12) and at least one key (16) is securely attached to the key attachment means (14). At least one set of instructions (18) are inscribed on the tag (12). The tag (12) includes a mailing address (20) having mailing address postage indicia (20A) inscribed on the tag (12). A microchip (22) which comprises an user's personal identifier therein embedded with the tag (12). A bar code (24) which comprises an user's personal identifier therein inscribed on the tag (12), along with a magnetic strip (26) which also has an user's personal identifier therein recorded. A method is included describing the method to record the user's personal identifier onto the tag (12).

9 Claims, 3 Drawing Sheets

KEY LOCATOR

BACKGROUND OF THE INVENTION

1. Field of the Invention

The present invention relates to key tag locators. More particularly, the present invention relates to key tag locators having a microchip embedded within a tag upon which instructions, mailing address with mailing address postage indicia, bar code and magnetic strip are affixed thereon. The microchip, bar code, and magnetic strip contain personal identifier information about the user.

2. Description of the Prior Art

Key locators are well known in the art. They are mainly grouped into one main category. The key tags which have hotel, motel or other return addresses which can be placed in a mail box if found or inadvertently taken and not returned by the user.

Numerous innovations for a have been provided in the prior art that are described as follows. Even though these innovations may be suitable for the specific individual purposes to which they address, they differ from the present invention as hereinafter contrasted.

In U.S. Pat. No. 5,419,591, titled Courier Waybill, invented by Francois Lamber, Thomas J. Goodwin, Patrick J. McGilly and Claude Debonville, a multi-ply courier waybill comprises a plurality of data plies connected along at least one marginal edge to an underlying backing ply having a pressure sensitive adhesive applied to the undersurface thereof for attachment to a package to be shipped. The backing ply includes a plurality of die cut labels formed over a portion thereof spaced inwardly from the marginal edges of the backing ply, and the pressure sensitive adhesive is covered by a release liner. Removal of the release liner from the surface of the adhesive will result in removal of the die cut labels from the backing ply. At least some of the data plies and the die cut labels are provided with common bar code indicia. The labels are applied to satellite packages so that only one waybill can accommodate a number of packages sent to the same addressee.

The patented invention differs from the present invention because the patented invention is a multiple copy way bill or shipping label. All information is readable. The present invention is a coded label having a return address of a subscriber service. The information on the present invention is read by the subscription service to determine the owner.

In U.S. Pat. No. 5,290,066, titled Magnetic Label and Use Thereof, invented by Hemant K. Mody, in situations such as the checkout of library books and video cassettes issued by video rental stores, it is desirable to indicate the date by which these materials are due. This patent describes a method and means for displaying the due date by using an erasable and re-writable media affixed to the issuable material. Device for writing/erasing this media is described. Furthermore, method and device for simultaneous reading of bar codes, writing the due date and altering the delectability state of a programmable magnetic strip are disclosed.

The patented invention differs from the present invention because the patented invention is adapted fro use in library books and other uses where information must be visible to the user. The patented invention stores information on a erasable/rightable media. Further a detectable strip may be armed or disarmed which functions as a anti theft device. The cards are imprinted with a visibly due date. The present invention is a key tag having embedded a coding means containing user information which is not readable with out a second device. The user encodes information with a subscription firm. The firm enters the information into a data bank and encodes the keytag. Should the user lose the keys, the tag has instructions for the finder to send back the keys to the firm. A device at the firm reads the coded information on the key tag. The user is notified by the firm and the keys returned to the user.

In U.S. Pat. No. 5,238,272, titled Protected Bar Code Label, invented by J. E. Gordon Taylor, a multiple ply label has an extension that includes a bar code symbol and the extension is folded under the label ply when the label is attached to an article for the purpose of protecting the bar code symbol. Another embodiment of the multiple ply label has a cutout portion that allows a bar code symbol to be positioned so as to be partially covered by an overlying ply when the label is attached to an article for the purpose of protecting one portion of the bar code symbol while exposing the other portion of the symbol. The overlying layers or plies of the multiple ply label can be removed at successive stations while protecting the bar code symbol.

The patented invention differs from the present invention because the patented invention is a multi ply label functioning to protect a bar code. The present invention is a key tag having embedded a coding means containing user information. The user encodes information with a subscription firm. The encodable media is contained therein and is protected by the key tag structure. The firm enters the information into a data bank and encodes the keytag. Should the user lose the keys, the tag has instructions for the finder to send back the keys to the firm. The user is notified by the firm and the keys returned to the user.

In U.S. Pat. No. 4,523,088, titled Code Bar for Identification of Series Parts, a code bar for the identification of series parts, for example vehicle bodies, within an assembly line, with several codings in the form of alternating bright and dark stripes of differing widths, corresponding respectively to the digits 0 through 9, consists of a sheet-metal strip from which the dark stripes of the codings have been punched out as slots. The sheet-metal strip is preferably edged twice, preferably along the narrow sides, in order to form mounting flanges, so that the codings are arranged at a spacing from the series part, and exhibits longitudinal crimps in the proximity of the longitudinal borders.

The patented invention differs from the present invention because the patented invention is robust bar code tag capable of with standing painting, heat, weather, and corrosive fluids. It functions to tag products undergoing manufacturing processes. The construction is such that it is readable when subjected a harsh manufacturing environment. The present invention is a key tag having embedded a coding means containing user information. The user encodes information with a subscription firm. The firm enters the information into a data bank and encodes the keytag. Should the user lose the keys, the tag has instructions for the finder to send back the keys to the firm. The user is notified by the firm and the keys returned to the user.

In U.S. Pat. No. 4,763,930, titled Transparent Gammer Label having See Through Indicia and Opaque Universal Product Code Bar and Numerical Indicia at a Side Thereof on Small Nail Polish Bottles, invented by Arthur Matney, an invention relates to a transparent gummed label for small nail polish glass containers fitted with a cap-applicator, the label being formed of a pre-cut clear cellulose acetate sheet having translucent light colored printing over a major proportion of the back and the bar code printed on the front of the sheet. Specifically the left back side of the sheet is printed with a first light colored material identifying the supplier and the shade of the nail polish contents. Immediately adjacent thereto but on the front side there is a second printing of a white opaque background located on the right side which is a minor portion of the sheet and which is then overprinted with the opaque black Universal Product Code Bar Code and then with the Universal Product Numbers adjacent the Bar Code. The back side of the sheet is then coated with a clear pressure sensitive adhesive so that the label is then applied to a small glass container (½ fluid ounce) for nail polish. The transparent light colored indicia on the back side identify the manufacturer supplier, the shade of nail polish, the fluid contents (½ fluid oz. Or 15 ml) and give instructions to shake well before removing the cap. The consumer can match the shade to any desired color and readily sees through the label which is of a significantly large size in relation to the size of the glass container. The label facilitates consumer selection of any shade desired in an offering of about 75–80 nail polish colors.

The patented invention differs from the present invention because the patented invention is a label having a barcode which is readable to the user. The patented invention is self adhesive and is applied to the outside of a container with the barcode visible. The present invention is a key tag having embedded a coding means containing user information which is not visible. The user encodes information with a subscription firm. The firm enters the information into a data bank and encodes the keytag. Should the user lose the keys, the tag has instructions for the finder to send back the keys to the firm. The user is notified by the firm and the keys returned to the user.

Numerous innovations for a key locator have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to key tag locators. More particularly, the present invention relates to key tag locators having a microchip embedded within a tag upon which instructions, mailing address with mailing address postage indicia, bar code and magnetic strip are affixed thereon. The microchip, bar code, and magnetic strip contain personal identifier information about the user. The tag can be in any size, shape or design which is configured customized or has a corporate design upon which an user attaches keys. The primary purpose of the key identification system is to allow a person who finds the lost keys to contact a third party who in turn returns the keys to the user. The microchip, bar code, and magnetic strip contain encrypted personal identifier information to allow the user to remain private to the finder in the case of lost or stolen keys. The key locator could be used by home owners, businesses, automobile owners, bed and breakfasts, motels, hotels, resorts, and all other industries who are willing to subscribe to the service.

The types of problems encountered in the prior art are if the key locator is old and used, the mailing address often wears out and is unreadable.

In the prior art, unsucessful attempts to solve this problem were attempted namely: making the address labels less pervious to wear and tear. However, the problem was solved by the present invention because it incorporated four different types of identification such as mailing address with mailing address postage indicia, microchip, bar code, and magnetic strip that contain personal identifier information which a person finding the lost keys can contact the third party to return the keys to the user. In addition, the microchip is embedded into the tag and is completely impervious to wear and tear.

Innovations within the prior art are rapidly being exploited in the field of returning lost keys.

The present invention went contrary to the teaching of the art which describes and claims key tags having printed indicia thereon.

The present invention solved a long felt need for a key locator which is private and involves a third party to forward the lost keys to the user.

Accordingly, it is an object of the present invention to provide a key locator having a tag attached to a key by a key attachment means.

More particularly, it is an object of the present invention to provide the tag having a tag opening through which the key attachment means is secured.

In keeping with these objects, and with others which will become apparent hereinafter, one feature of the present invention resides, briefly stated, in the tag having a tag front upon which instructions, mailing address with mailing address postage indicia, bar code, and magnetic strip are displayed thereon.

When the tag is designed in accordance with the present invention, a microchip is embedded therein.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10—key locator (10)
12—tag (12)
12A—tag opening (12A)
12F—tag front (12F)
14—key attachment means (14)
16—key(16)
18—instructions (18)
20—mailing address (20)
20A—mailing address postage indicia (20A)
22—microchip (22)
24—bar code (24)
26—magnetic strip (26)
110—method (110) of manufacturing a key locator (10)
112—selecting (112) a personal identifier for an user
114—first transcribing (114) the user's personal identifier into a microchip (22)
116—covering (116) the user's personal identifier microchip (22) with a tag (12)
118—second transcribing (118) the user's personal identifier into a bar code (24)
120—first inscribing (120) the user's personal identifier bar code (24) onto the tag (12)
122—third transcribing (122) the user's personal identifier into a magnetic strip (26)
124—second inscribing (124) the user's personal identifier magnetic strip (26) onto the tag (12)
126 -third inscribing (126) instructions (18) onto the tag (12)

128 -forth inscribing (128) a mailing address (20) onto the tag (12)

130 -fifth inscribing (130) mailing address postage indicia (20A) onto the tag (12)

DESCRIPTION OF THE PREFERRED EMBODIMENT

Figure 1:
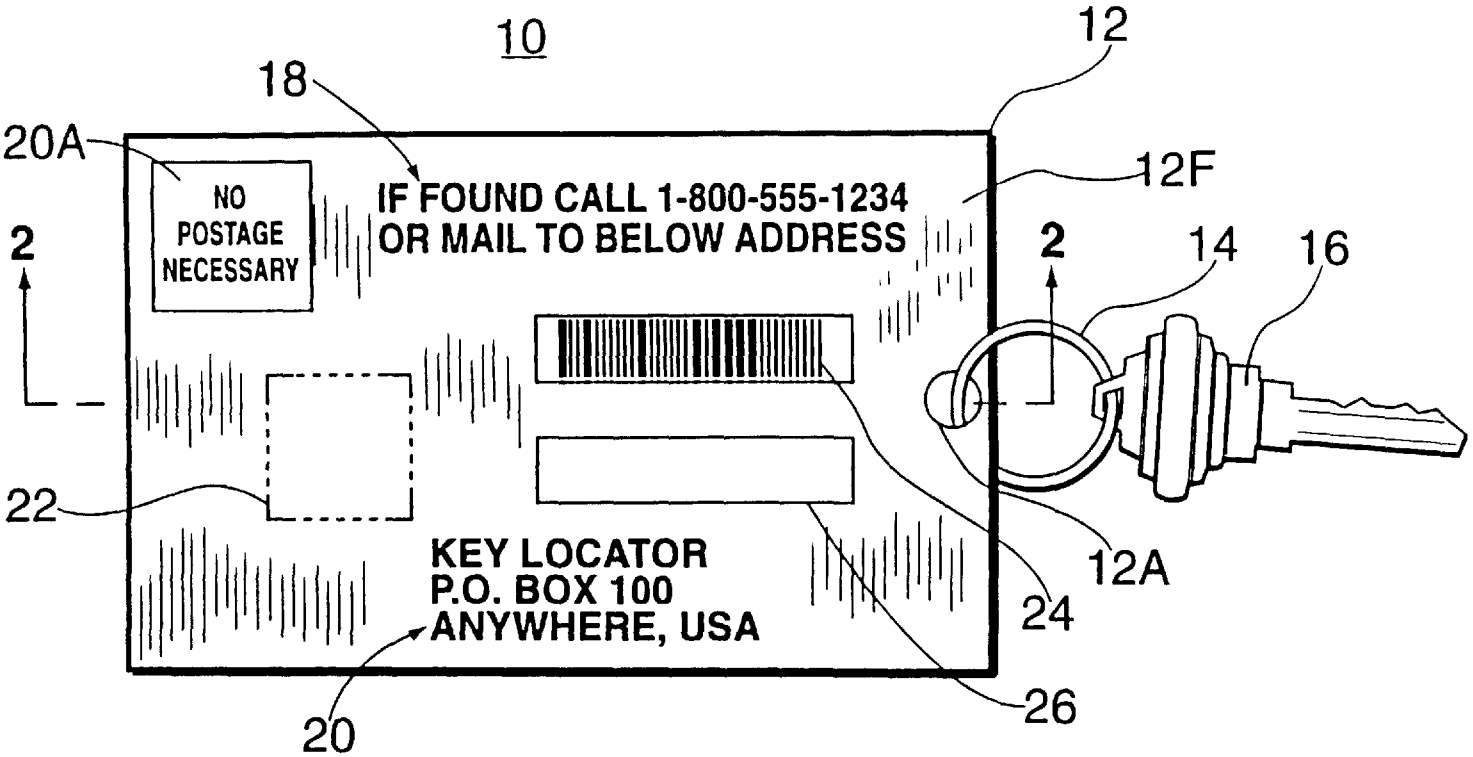
FIG. 1 is a front view of a key locator.
Figure 2:
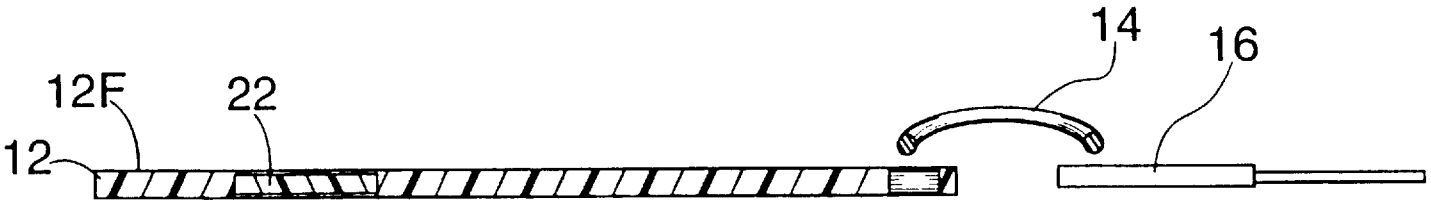
FIG. 2 is a cross sectional view of a key locator along line 2—2 of FIG. 1.

Firstly referring to FIG. 1 which is a front view of a key locator (10) and FIG. 2 which is a cross sectional view of a key locator (10) along line 2—2 of FIG. 1. The key locator (10) comprises a tag (12). The key locator (10) further comprises a key attachment means (14) securely attached to the tag (12).The key locator (10) further comprises at least one key (16) securely attached to the key attachment means (14). The key locator (10) further comprises at least one set of instructions (18) inscribed on the tag (12). The key locator (10) further comprises a mailing address (20) having mailing address postage indicia (20A) inscribed on the tag (12). The mailing address (20) is preferably not the address of the user for security reasons but a third party who will forward the lost keys to the user.

The key locator (10) further comprises a microchip (22) which comprises an user's personal identifier therein embedded with the tag (12). The key locator (10) further comprises a bar code (24) which comprises an user's personal identifier therein inscribed on the tag (12). The bar code (24) is preferably a standard UPC which can be read at any location having a reader device such that a person who finds the lost keys can call the telephone number on the instructions and give the personal identifier over the phone to the third party who it turn notifies the user that the keys have been recovered and are presently being mailed to the third party. The key locator (10) further comprises a magnetic strip (26) which comprises an user's personal identifier therein attached to the tag (12). The magnetic strip (26) is preferably standard such as a credit card magnetic strip which can be read at any location having a reader device for the same reasons stated herein above.

The tag (12) preferably further comprises a tag opening (12A) through which the key attachment means (14) is secured. The tag (12) optionally further comprises a tag front (12F) upon which the instructions (18), the mailing address (20), the mailing address postage indicia (20A), the bar code (24), and the magnetic strip (26) are displayed. The tag (12) may optionally have a tag back (not shown) upon which some of the instructions (18), the mailing address (20), the mailing address postage indicia (20A), the bar code (24), and the magnetic strip (26) may be affixed thereon. The tag (12) is constructed from a material selected from a group consisting of plastic, plastic composite, rubber, rubber composite, metal, metal alloy, leather, wood, fiberglass, epoxy, and carbon-graphite. The tag (12) is preferably constructed from plastic or plastic composite which is durable and impervious to the weather.

Figure 3:
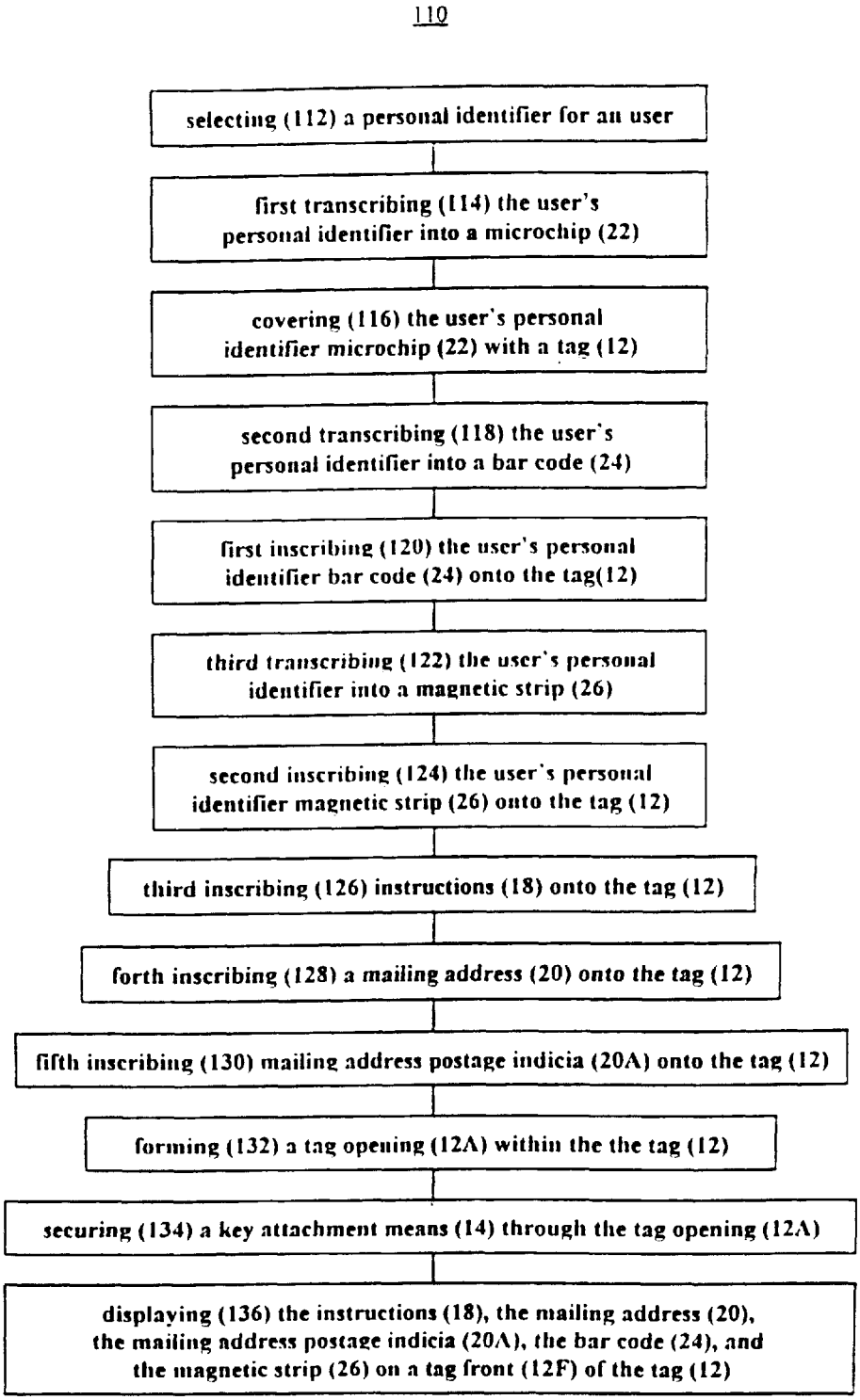
FIG. 3 is a diagrammatic representation of a method of manufacturing a key locator.

Referring to FIG. 3 which is a diagrammatic representation of a method (110) of manufacturing a key locator (10) consisting of the following steps:

A) selecting (112) a personal identifier for an user;

B) first transcribing (114) the user's personal identifier into a microchip (22);

C) covering (116) the user's personal identifier microchip (22) with a tag (12);

D) second transcribing (118) the user's personal identifier into a bar code (24);

E) first inscribing (120) the user's personal identifier bar code (24) onto the tag(12);

F) third transcribing (122) the user's personal identifier into a magnetic strip (26);

G) second inscribing (124) the user's personal identifier magnetic strip (26) onto the tag (12);

H) third inscribing (126) instructions (18) onto the tag (12);

I) forth inscribing (128) a mailing address (20) onto the tag (12); and J) fifth inscribing (130) mailing address postage indicia (20A) onto the tag (12).

The method (110) of manufacturing a key locator (10) may optionally further consist of the following steps:

K) forming (132) a tag opening (12A) within the tag (12);

L) securing (134) a key attachment means (14) through the tag opening (12A); and M) displaying (136) the instructions (18), the mailing address (20), the mailing address postage indicia (20A), the bar code (24), and the magnetic strip (26) on a tag front (12F) of the tag (12).

The method (110) of manufacturing a key locator (10) wherein the tag (12) is constructed from a material selected from a group consisting of plastic, plastic composite, rubber, rubber composite, metal, metal alloy, leather, wood, fiberglass, epoxy, and carbon-graphite.

It will be understood that each of the elements described above, or two or more together, may also find a useful application in other types of constructions differing from the type described above.

While the invention has been illustrated and described as embodied in a key locator, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims

What is claimed is:

1. A key locator (10) comprising:

A) a tag (12);

B) a key attachment means (14) securely attached to the tag (12);

C) at least one key (16) securely attached to the key attachment means (14);

D) at least one set of instructions (18) inscribed on the tag (12);

E) a mailing address (20) having mailing address postage indicia (20A) inscribed on the tag (12);

F) a microchip (22) which comprises an user's personal identifier therein embedded with the tag (12);

G) a bar code (24) which comprises an user's personal identifier therein inscribed on the tag (12); and H) a magnetic strip (26) which comprises an user's personal identifier therein attached to the tag (12).

2. The key locator (10) as described in claim 1, wherein the tag (12) further comprises a tag opening (12A) through which the key attachment means (14) is secured.

3. The key locator (10) as described in claim 1, wherein the tag (12)further comprises a tag front (12F) upon which the instructions (18), the mailing address (20), the mailing address postage indicia (20A), the bar code (24), and the magnetic strip (26) are displayed.

4. The key locator (10) as described in claim 1, wherein the tag (12) is constructed from a material selected from a group consisting of plastic, plastic composite, rubber, rubber composite, metal, metal alloy, leather, wood, fiberglass, epoxy, and carbon-graphite.

5. A method (110) of manufacturing a key locator (10) consisting of the steps of:

A) selecting (112) a personal identifier for an user;

B) first transcribing (114) the user's personal identifier into a microchip (22);

C) covering (116) the user's personal identifier microchip (22) with a tag (12);

D) second transcribing (118) the user's personal identifier into a bar code (24);

E) first inscribing (120) the user's personal identifier bar code (24) onto the tag(12);

F) third transcribing (122) the user's personal identifier into a magnetic strip (26);

G) second inscribing (124) the user's personal identifier magnetic strip (26) onto the tag (12);

H) third inscribing (126) instructions (18) onto the tag (12);

I) fourth inscribing (128) a mailing address (20) onto the tag (12); and J) fifth inscribing (130) mailing address postage indicia (20A) onto the tag (12).

6. The method (110) of manufacturing a key locator (10) as described in claim 5 further consists of a step of forming (132) a tag opening (12A) within the the tag (12).

7. The method (110) of manufacturing a key locator (10) as described in claim 6 further consists of a step of securing (134) a key attachment means (14) through the tag opening (12A).

8. The method (110) of manufacturing a key locator (10) as described in claim 5 further consists of a step of displaying (136) the instructions (18), the mailing address (20), the mailing address postage indicia (20A), the bar code (24), and the magnetic strip (26) on a tag front (12F) of the tag (12).

9. The method (110) of manufacturing a key locator (10) as described in claim 5, wherein the tag (12) is constructed from a material selected from a group consisting of plastic, plastic composite, rubber, rubber composite, metal, metal alloy, leather, wood, fiberglass, epoxy, and carbon-graphite.

* * * * *